United States Patent [19]

Held

[11] Patent Number: 4,501,195

[45] Date of Patent: Feb. 26, 1985

[54] AIR DEFLECTOR

[76] Inventor: Peter J. Held, 46 Heather Ave., Kitchener, Ontario N2B 1M1, Canada

[21] Appl. No.: 552,792

[22] Filed: Nov. 17, 1983

[51] Int. Cl.[3] ..... F24F 13/06

[52] U.S. Cl. ..... 98/103

[58] Field of Search ..... 98/40 R, 101, 103, 105, 98/108, 109, 114, DIG. 7

[56] References Cited

U.S. PATENT DOCUMENTS

| | | | |
|---|---|---|---|
| 1,514,396 | 11/1924 | Pouley et al. | 98/103 X |
| 2,080,726 | 5/1937 | Lowinger | 98/103 X |
| 2,743,660 | 5/1956 | Scherff | 98/103 |
| 3,225,679 | 12/1965 | Meyer | 98/103 |

FOREIGN PATENT DOCUMENTS

| | | | |
|---|---|---|---|
| 2439630 | 3/1976 | Fed. Rep. of Germany | 98/105 |

*Primary Examiner*—Harold Joyce

*Attorney, Agent, or Firm*—Daryl W. Schnurr

[57] ABSTRACT

An air deflector for use with an air register of the type commonly found in residences, has a rectangular sheet of flexible material with two opposing edges folded in the same direction to form a flange along each edge. The sheet has sufficient rigidity so that the folded position is maintained and the deflector has an inverted U-shaped cross-section when mounted on the register with one of the flanges placed along each side. Magnetic material on the flanges holds the deflector in place on the register.

6 Claims, 4 Drawing Figures

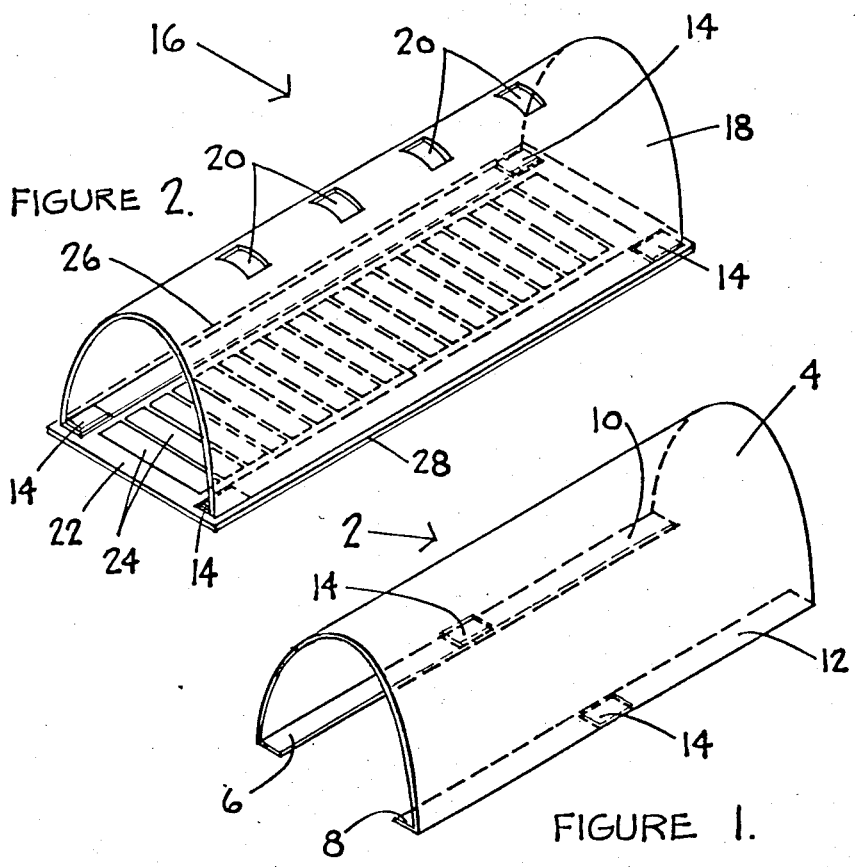
FIGURE 2.
FIGURE 1.
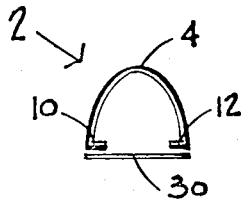
FIGURE 3
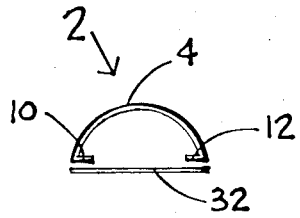
FIGURE 4

AIR DEFLECTOR

BACKGROUND OF THE INVENTION

1. Field of the Invention

This invention relates to an air deflector for use with an air register and, in particular, for use with the type of air registers commonly found in residences.

2. Description of the Prior Art

Air registers commonly found in residences are connected to air vents or ducts which in turn are connected to either a central heating source or cooling source or both. The heating source is usually a furnace and the cooling source is usually an air conditioning unit. When hot air is blowing through said register and the register is floor mounted, the warm air is blown towards the ceiling of a room in which the register is located. Since warm air rises, it can be inefficient to heat a room in a manner in which warm air is allowed to immediately rise to the ceiling and remain there. When cold air is blown through an air register in a room to be cooled, if no deflector is used on the register, the cold air can cause drafts for the occupants of the room. Similarly, when hot air is blown through the register, it can be uncomfortably warm for an occupant of the room located close to the register.

When an air deflector is used on the register, drafts and uneven temperatures for occupants are minimized. Also, the room can be heated more efficiently through the use of an air deflector. It is known to use air deflectors on air registers, whether the registers are used for heating or cooling. However, previous deflectors are relatively expensive to manufacture; or, they can be easily broken, particularly, when the are located on a floor-mounted register and are inadvertently stepped on by a user; or they are not adjustable for air registers of varying widths; or they are relatively expensive to transport; or they direct air from the register towards an occupant, thereby causing him discomfort; or they cannot be made compact when stored.

It is an object of the present invention to provide an air deflector that can be mounted on an air register to direct air from the register along the wall of a room and is durable and compact and relatively inexpensive to manufacture.

SUMMARY OF THE INVENTION

An air deflector in accordance with the present invention is used with an air register through which air is passed, said register having at least two parallel sides. The air deflector has a rectangular sheet of flexible and resilient material having two opposing edges that are folded in the same direction so that a flange is formed along each of said opposing edges. The sheet has sufficient rigidity so that said flanges remain in position after the sheet is folded. The deflector has an inverted U-shaped cross-section when mounted on said register with one of said flanges placed along each of said parallel sides of said register, with means to hold said flanges on said sides. The sheet has sufficient resiliency so that said deflector will return to said inverted U-shape after an external force that changes the shape of the deflector has been removed. The sheet has sufficient flexibility so that one deflector can be used with registers of different sizes.

BRIEF DESCRIPTION OF THE DRAWINGS

In drawings which illustrate a preferred embodiment of the invention:

FIG. 1 is a perspective view of an air deflector in accordance with the present invention;

FIG. 2 is a perspective view of a further embodiment of an air deflector in accordance with the present invention mounted on an air register, said deflector having openings therein;

FIG. 3 is an end view of a deflector in accordance with the present invention mounted on a register; and FIG. 4 is an end view of a deflector of the same size as the deflector shown in FIG. 3 mounted on a wider register than that shown in FIG. 3.

DESCRIPTION OF A PREFERRED EMBODIMENT

Referring to the drawings in greater detail, in FIG. 1, there is shown one embodiment of an air deflector 2 in accordance with the present invention. The deflector 2 has a sheet 4 of flexible material having at least two opposing edges 6, 8. The sheet 4 is folded along each of said edges 6, 8 in the same direction to form flanges 10, 12 respectively. The sheet 4 has sufficient rigidity so that the folded position is maintained and the deflector 2 has an inverted U-shaped cross-section when mounted on an air register (not shown in FIG. 1) through which air is passed. There are means affixed to each of the flanges 10, 12 to mount the deflector 2 onto an air register. As shown in FIG. 1, the means are magnetic material or magnets 14. The sheet 4 of flexible material is preferably made of plastic that is still more preferably transparent. A particular type of plastic that works well is called LEXAN (a trade mark) having a thickness of 7,000 μm to 10,000 μm.

For clarity of illustration those portions of the deflectthat is still more preferably transparent. A particular type of plastic that works well is called LEXAN (a trade mark) having a thickness of 7,000 μm to 10,000 μm.

For clarity of illustration those portions of the deflector and the register that are located behind or beneath the deflector are drawn with dotted lines even though the deflector shown is transparent.

As shown in FIG. 2, an air deflector 16 has a sheet 18 of flexible material with edges 6, 8 and flanges 10, 12 respectively similar to the deflector 2 of FIG. 1. The main difference between the deflector 16 and the deflector 2 is that the deflector 16 has a series of openings 20 therein. The openings 20 allow some of the air leaving the air register 22 on which the deflector 16 is mounted to pass directly through the deflector without being deflected. The air register 22 has a plurality of vents 24 to allow air to pass through it. Air from the register 22 that does not pass through one of the openings 20 is deflected out either end of the deflector 16. In some installations, the openings 20 or variations in the openings 20 may be desirable in order to provide an even temperature distribution in the space or room where the deflector is located. It will also be noticed that the magnetic material 14 is arranged differently in FIG. 2 from the material 14 in FIG. 1. Other variations will be readily apparent. As with the sheet 4 of FIG. 1, the sheet 18 has sufficient rigidity so that the folded position is maintained and the deflector has an inverted U-shaped cross-section when mounted on the register 22 with one of said flanges 10, 12 placed along each of the opposing sides 26, 28 of the register 22.

The sides 26, 28 of the register 24 are parallel and the register is rectangular in shape. The edges 6, 8 of the sheet 18 are also parallel and the sheet is rectangular in shape. While rectangularly shaped registers are most common, it will be readily apparent to those skilled in the art that other deflectors, within the scope of the attached claims could be designed for registers of various shapes. Also, while the magnetic material is shown on the flanges 10, 12 of the air deflectors, it is not essential that there be any means affixed to these flanges. The register itself could simply be lifted up and the flanges 10, 12 could be inserted beneath the sides 26, 28 of the register.

As shown in FIGS. 3 and 4, an air deflector 2 of the same size can be used to fit registers 30, 32, of varying width. The register 30 is narrower than the register 32 but the deflector 2 is the same size in each of said Figures. The sheet 4 has the same length between flanges 10, 12. The effect on the deflector is simply that the inverted U-shaped cross-section of FIG. 3 is higher than the inverted U-shaped cross-section of FIG. 4. For purposes of illustration, the flanges 10, 12 of the deflector 2 in FIGS. 3 and 4 is shown to be out of contact with the registers 30, 32. In actual use, the flanges would normally be in contact with the opposing sides of the registers.

While the present invention is best used on floor-mounted air registers, it could also be used on wall-mounted or even ceiling mounted air registers. For wall-mounted or ceiling-mounted air registers, the deflector would require sufficient magnetic material or other mounting means so that it will not fall off the air register. If convenient, as stated above, the flanges of the deflector can be used to mount the deflector on the register by inserting the flanges between the sides of the air registers and the place in which the registers are mounted.

The air deflector of the present invention will not break or crack when it is stepped on in normal usage. Because it is flexible, it will simply adapt to the pressure that is placed upon it and will return to its original shape once the pressure is released. For handling, shipping and packaging, the deflector can be formed into a roll so that it is very compact. The same can be done when it is desired to store the deflector during those seasons of a year when it is not required.

In operation, when the deflector is mounted on an air register, air coming from the register is deflected out either end of the deflector. If the deflector has openings 20 in it, some of the air from the register will pass directly through the deflector. Since most registers are located adjacent to and parallel to a wall of a room, the deflector will also be located adjacent to and parallel to a wall of the room. Therefore, air coming through the register will pass from the deflector through either end and travel along the wall. Because the air is directed along the wall, it is less likely that it will cause drafts or be blown directly at occupants of the room.

What I claim as my invention is:

1. An air deflector for use with an air register through which air is passed, said register having two parallel sides, said deflector comprising a rectangular sheet of flexible and resilient material having two opposing edges that are folded in the same direction so that a flange is formed along each of said opposing edges, said sheet having sufficient rigidity so that said flanges remain in position after the sheet is folded, the deflector having an inverted U-shaped cross-section when mounted on said register with one of said flanges placed along each of said parallel sides of said register, with means to hold said flanges on said sides, said sheet having sufficient resiliency so that said deflector will return to said inverted U-shape after an external force that changes the shape of the deflector has been removed, said sheet having sufficient flexibility so that one deflector can be used with registers of different sizes.

2. An air deflector as claimed in claim 1 wherein the flanges are each folded substantially 90° relative to a remainder of said sheet.

3. An air deflector as claimed in claim 2 wherein the means affixed to each of said flanges is magnetic material.

4. An air deflector as claimed in claim 2 wherein the sheet of flexible material is made of plastic that can withstand the heat generated by air leaving the register.

5. An air deflector as claimed in claim 2 wherein the sheet of material is transparent.

6. An air deflector as claimed in claim 2 wherein there are openings in the sheet to allow some air from the register to pass directly through the deflector.

* * * * *